US011974650B2

(12) United States Patent
Jourdain et al.

(10) Patent No.: US 11,974,650 B2
(45) Date of Patent: May 7, 2024

(54) MECHANISM FOR A RECEPTACLE FOR APPLYING A COSMETIC PRODUCT, RECEPTACLE INCLUDING SUCH A MECHANISM AND METHOD FOR OBTAINING SUCH A MECHANISM

(71) Applicant: ALBEA SERVICES, Gennevilliers (FR)

(72) Inventors: Marc Jourdain, Gennevilliers (FR); Erwan Lechevillier, Gennevilliers (FR); Renan Levaillant, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 78 days.

(21) Appl. No.: 17/234,723

(22) Filed: Apr. 19, 2021

(65) Prior Publication Data

US 2021/0321745 A1 Oct. 21, 2021

(51) Int. Cl.

| | |
|---|---|
| ***A45D 40/04*** | (2006.01) |
| ***A45D 40/06*** | (2006.01) |
| *A45D 40/00* | (2006.01) |

(52) U.S. Cl.

CPC ..... *A45D 40/04* (2013.01); *A45D 40/06* (2013.01); *A45D 40/065* (2013.01); *A45D 2040/0012* (2013.01); *A45D 2040/0025* (2013.01); *A45D 2200/05* (2013.01)

(58) Field of Classification Search

CPC ..... A45D 40/06; A45D 40/065; A45D 40/04; A45D 2040/208; A45D 2040/0025

See application file for complete search history.

(56) References Cited

U.S. PATENT DOCUMENTS

| | | | | |
|---|---|---|---|---|
| 5,597,252 | A | 1/1997 | Ito et al. | |
| 6,139,208 | A * | 10/2000 | Monin-Bareil | A45D 40/06 401/78 |
| 11,064,787 | B2 * | 7/2021 | Liu | A45D 40/06 |
| 11,129,463 | B2 * | 9/2021 | Dinata | A45D 40/06 |
| 11,246,394 | B2 * | 2/2022 | Liu | A45D 40/06 |
| 2013/0322949 | A1 | 12/2013 | Braeuer et al. | |
| 2019/0246768 | A1 | 8/2019 | Xu | |
| 2019/0328109 | A1 | 10/2019 | Lin | |
| 2022/0400834 | A1 * | 12/2022 | Lecureuil | A45D 40/06 |

FOREIGN PATENT DOCUMENTS

| | | |
|---|---|---|
| CN | 108143077 A | 6/2018 |
| GB | 1123646 A | 8/1968 |
| JP | H0819422 | 1/1996 |
| JP | H08117022 | 5/1996 |
| JP | 2010029430 | 2/2010 |
| JP | 2020025622 | 2/2020 |

OTHER PUBLICATIONS

CN202110393060.4, English Translation of "First Office Action", Jul. 31, 2023, 6 pages.

* cited by examiner

*Primary Examiner* — Jennifer C Chiang
(74) *Attorney, Agent, or Firm* — Kilpatrick Townsend & Stockton LLP

(57) ABSTRACT

A mechanism for a receptacle for applying a cosmetic product is provided. The mechanism is designed to make the cosmetic product exit by at least one rotation movement, the mechanism including at least one sheath made of plastic material and a casing made of plastic material external to the sheath, the casing and the sheath being interfused in at least one point, called assembly point, so as to be integral in rotation and in translation.

11 Claims, 6 Drawing Sheets

[Fig.1]
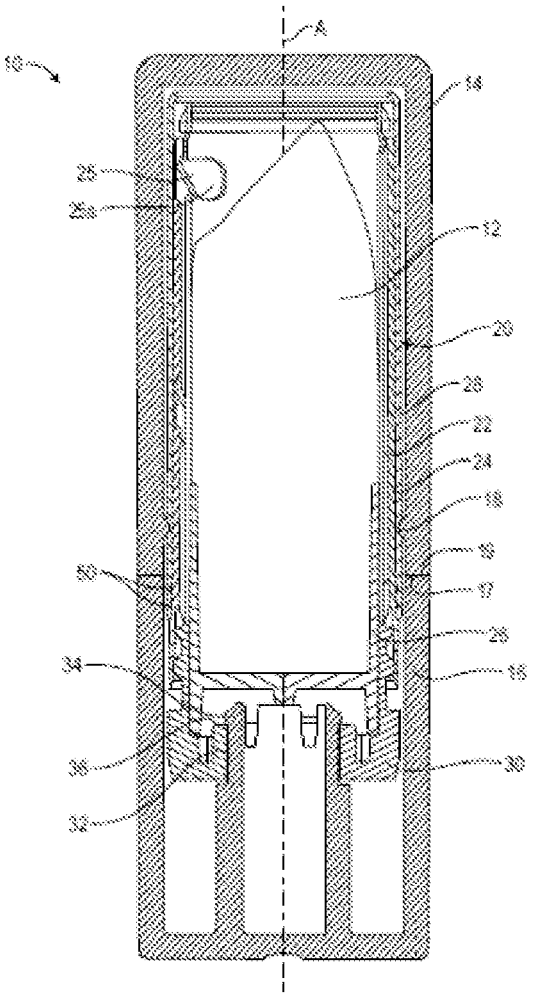

[Fig.2]
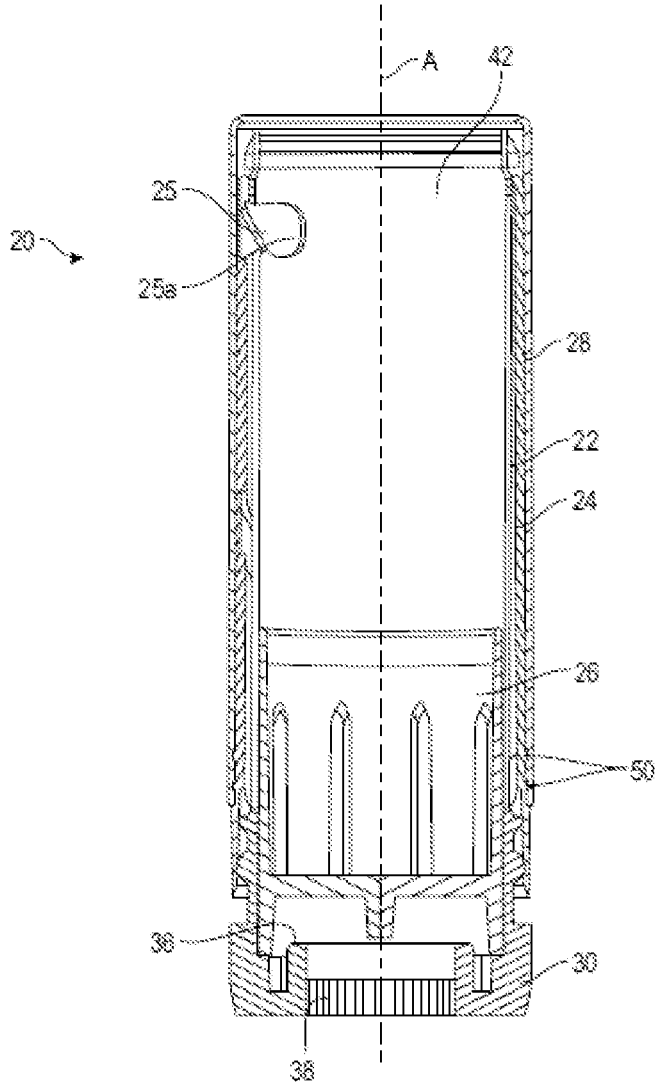

[Fig.3]
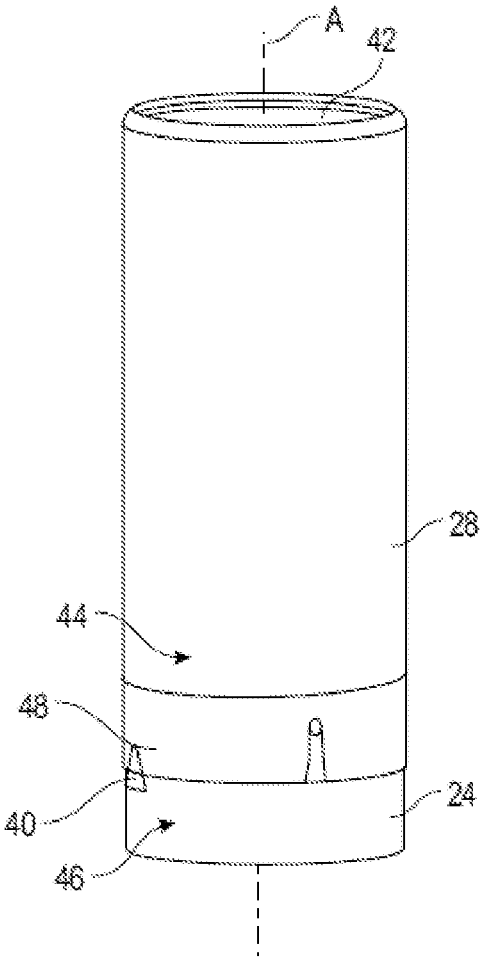

[Fig.4]
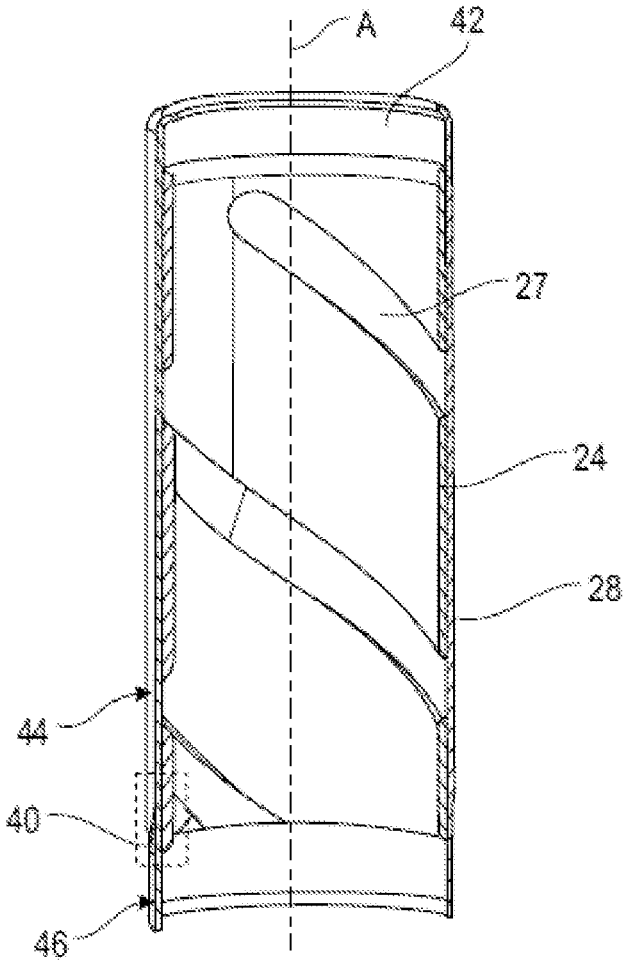

[Fig.5]
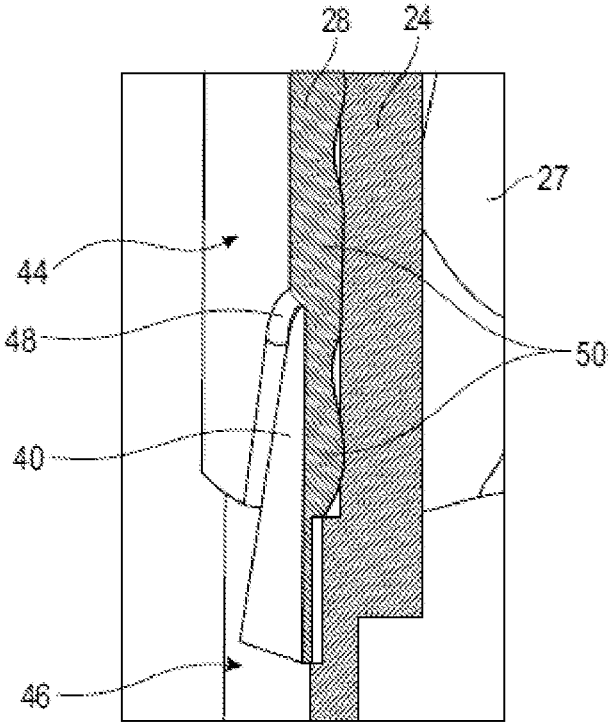

[Fig.6]
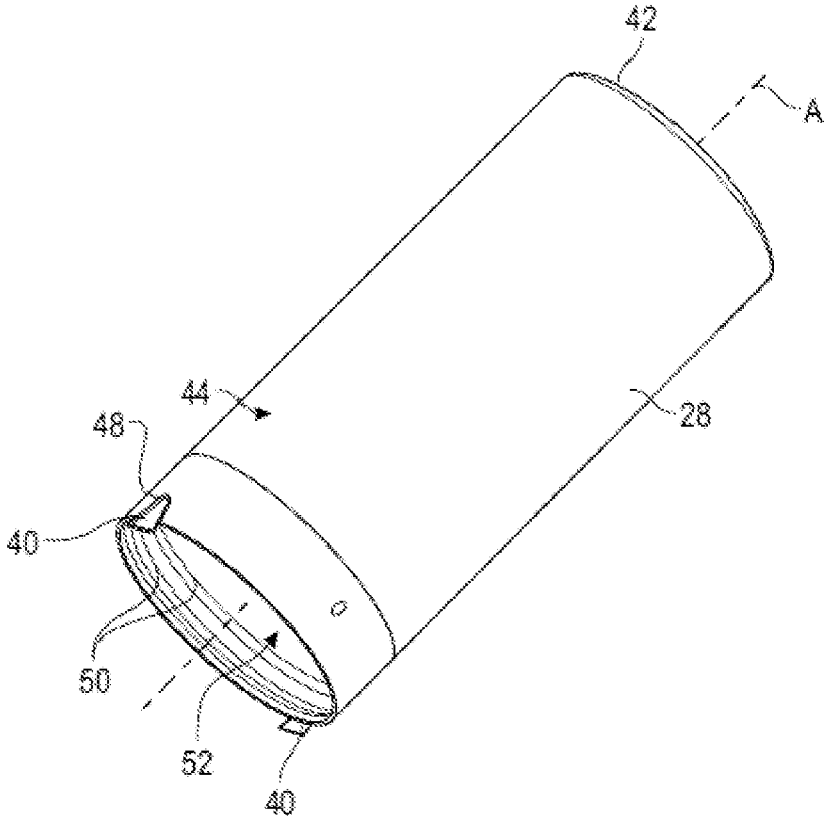

MECHANISM FOR A RECEPTACLE FOR APPLYING A COSMETIC PRODUCT, RECEPTACLE INCLUDING SUCH A MECHANISM AND METHOD FOR OBTAINING SUCH A MECHANISM

CROSS REFERENCE TO RELATED APPLICATIONS

This application claims priority under 35 U.S.C. § 119(a) to French patent application number 2003875, filed on Apr. 17, 2020, the entire teachings of which are incorporated herein by reference.

BACKGROUND OF THE INVENTION

Field of the Invention

The invention relates to a mechanism for a receptacle for applying a cosmetic product, in particular a lipstick, and a receptacle including such a mechanism.

Description of the Related Art

Conventionally, receptacles for applying a cosmetic product, in particular a lipstick, include a mechanism allowing to move the cosmetic product between a retracted position and an application position, wherein the cosmetic product is likely to be applied by friction.

The actuation of the mechanism is generally controlled manually by applying a rotation movement to the base of the receptacle, which rotation movement is transmitted to the mechanism to cause the axial movement of a cup including the cosmetic product.

This type of mechanism generally includes at least one casing, also called sleeve, fitted on a sheath contributing to the movement of the cosmetic product. The casing is a visible aesthetic part, since extending outside of the base of the receptacle inside which the remainder of the mechanism is housed.

Conventionally, the casing and the sheath are made in the form of two separate parts for which it is possible to freely choose the material. In such a design, the two parts must be integrally connected to one another.

Typically, a metal material, such as anodised aluminium, is chosen for the casing and a plastic casing is chosen for the sheath of the mechanism.

The metal material of the casing allows to mount it on the sheath by crimping, punching or gluing which are techniques having the advantage of simultaneously ensuring an axial connection and a rotating connection between the casing and the sheath.

However, the presence of two different materials, metal and plastic, has disadvantages, in particular during the recycling where the two parts must be separated.

It is also possible to produce the casing and the sheath of the mechanism, both made of plastic material.

The assembly of the two parts can thus be done by clamping, but very often this is not sufficient, in particular at the level of the axial connection.

Another solution for assembling the two parts is the gluing technique. However, the use of glue induces risks of pollution of the cosmetic product by the glue of which it is difficult to control the quantity and the distribution with great precision during the assembly.

BRIEF SUMMARY OF THE INVENTION

The aim of the invention is in particular to propose a new mechanism design allowing to resolve at least some of the disadvantages of the state of the art, while having a connection between the casing and the sheath which is advantageously simple, reliable and economical.

Thus, the invention relates to a mechanism intended to be mounted on an actuation base of a receptacle for applying a cosmetic product, the mechanism being designed to make the cosmetic product exit through at least one rotation movement, characterised in that the mechanism includes:

- at least one sheath made of plastic material internally including at least one helical groove;
- a guide including a wheel intended to allow the rotation of the guide, the wheel being intended to be connected in rotation to the base;
- a casing made of plastic material external to the sheath, the casing and the sheath being interfused in at least one point, called assembly point, so as to be integral in rotation and in translation.

In other words, the casing and the sheath up to that point two separate parts do not form more than one single part and are connected, combined definitively at the level of the at least one assembly point. This is in particular allowed by a mixture of the plastic materials of the casing and of the sheath at the level of the assembly point.

According to different embodiments of the invention, which can be taken together or separately:

- the guide is surrounded by the sheath,
- the guide includes slides extending axially rectilinearly,
- the casing has an outer surface on which the at least assembly point is visible,
- the mechanism includes a plurality of assembly points,
- the plurality of assembly points is distributed over the perimeter of the casing,
- the plurality of assembly points is regularly distributed over the perimeter of the casing,
- the plurality of assembly points is distributed over the whole height of the casing,
- the plurality of assembly points is regularly distributed over the whole height of the casing,
- the at least one assembly point is a pattern, such as a logo, a letter, a text,
- the sheath internally includes at least one helical groove,
- the plastic material of the casing is chosen from among polypropylene and/or polyethylene terephthalate,
- the plastic material of the sheath is chosen from among polypropylene and/or polyethylene terephthalate,
- the mechanism includes a cup carrying the cosmetic product stick,
- the mechanism includes a guide surrounded by the sheath,
- the rotating of the guide with respect to the sheath causes an axial movement of the cup,
- the cup is made of plastic material chosen from among polypropylene and/or polyethylene terephthalate,
- the guide is made of plastic material chosen from among polypropylene and/or polyethylene terephthalate,
- all the parts of the mechanism are made of plastic material chosen from among polypropylene and/or polyethylene terephthalate,
- the casing is held on the sheath by way of at least one excess thickness of material located between the sheath and the casing, such that the sheath and the casing are integral, at least in translation,
- the excess thickness of material further allows that the sheath and the casing are integral in rotation,
- the at least one excess thickness of material is located on an inner surface of the casing,
- the at least one excess thickness of material is located on an outer surface of the sheath, the mechanism includes a plurality of excess thicknesses of material distributed over the inner surface of the casing, the mechanism includes a plurality of excess thicknesses of material distributed over the outer surface of the sheath, the at least one excess thickness of material is a protrusion of material arranged on the perimeter of the inner surface of the casing, the at least one excess thickness of material is a protrusion of material arranged on the perimeter of the outer surface of the sheath, the at least one excess thickness of material is two protrusions of material arranged on the perimeter of the inner surface of the casing, the at least one excess thickness of material is arranged on a lower portion of the casing and/or the sheath opposite an upper portion including an opening by which the cosmetic product can exit.

The invention also relates to a receptacle for applying a cosmetic product including a cap, an actuation base which includes a mechanism such as described below, the actuation base allowing an inlet and/or an outlet of the cosmetic product.

Advantageously, the cap is made of plastic material chosen from among polypropylene and/or polyethylene terephthalate and/or the base is made of plastic material chosen from among polypropylene and/or polyethylene terephthalate.

The invention finally relates to a method for obtaining a mechanism such as described below, including a step wherein the at least one assembly point is obtained by welding.

Advantageously, the welding is obtained by thermal punching.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is an axial cross-sectional view which represents a receptacle after mounting a mechanism according to the invention on an actuation base of the receptacle;

FIG. 2 is an axial cross-sectional view which represents the mechanism of FIG. 1;

FIG. 3 is a perspective view of an assembly of a sheath and a casing composing the mechanism of FIG. 2;

FIG. 4 is an axial cross-sectional view of the assembly of FIG. 3;

FIG. 5 is a magnified view of FIG. 4;

FIG. 6 is a perspective view of the casing of the assembly of FIG. 2.

DETAILED DESCRIPTION OF THE INVENTION

By convention, the "axial" direction corresponds to that of main extension of the receptacle, illustrated by the axis A in figures and the "radial" direction is orthogonal to the axial direction.

In the detailed description of the following figures, the terms "upper" and "lower" or also "top" and "bottom" will be used in a non-limiting manner in reference to the axial direction.

In the same manner, the terms "outer or external" and "inner or internal" are used in reference to the radial direction, an outer element being radially more extended from the axis A than an inner element.

Below in the description, elements having an identical structure or similar functions will be designated by same references.

In FIG. 1, an example of an embodiment of a receptacle 10 is represented, also called case, of a cosmetic product 10.

In the example of an embodiment, the cosmetic product is a cosmetic product stick 12 and more specifically, the cosmetic product stick 12 is a lipstick intended to be applied by friction, in a variant, a lip balm.

The receptacle 10 includes at least one cap 14 which is associated with an actuation base 16 having a complementary shape, the base 16 and the cap 14 together defining an outer edge of the receptacle 10.

The receptacle 10 further includes a mechanism 20 for the distribution of the cosmetic product stick 12.

In a non-limiting manner, the cap 14, the base 16 of the receptacle 10 and the mechanism 20 have a cylindrical shape of circular cross-section.

Preferably, the cap 14 is removable. The cap 14 is likely to occupy at least one opening position wherein the cap 14 is separated from the base 16 in view in particular of allowing the application of the cosmetic product and a closing position, wherein the cap 14 is integral with the base 16 (FIG. 1).

The lower portion of the cap 14 includes inside at least one annular protrusion 18 which is intended to engage with an outer cylindrical surface of the mechanism 20.

Advantageously, the annular protrusion 18 ensures the holding of the cap 14 in closing position and contributes to the obtaining of an airtight closing in order to guarantee a good conservation of the cosmetic product stick 12, when using the mechanism 20.

The cap 14 includes a lower edge 19 which is likely to abut against an upper edge 17 of the actuation base 16 in closing position.

In an embodiment, not represented, the base 16 can include a shoulder which extends radially to the level of the connection of the upper portion of the base 16 with a lower portion of greater diameter. The lower edge of the cap 14 is thus likely to abut against the shoulder in closing position.

An example of an embodiment of the mechanism 20 is illustrated in FIG. 2.

The mechanism 20 has a main axis which extends along the axial direction, combined with the main axis A of the receptacle 10.

The mechanism 20 is intended to be removably (or not) mounted on an actuation base 16, for example the actuation base 16 of the receptacle 10 for cosmetic product described above.

In the case of a removable mechanism 20, this is intended to be able to be changed, in particular but not exclusively after the complete use of the cosmetic product stick 12.

The mechanism 20 and its inlet and/or outlet mechanism of the cosmetic product stick 12 described below are only given as a non-limiting example.

In the example of the embodiment, the mechanism 20 includes an inner guide 22 of which the rotating with respect to an outer sheath 24 causes an axial movement of a cup 26 carrying the cosmetic product stick 12 allowing an inlet and/or an outlet of the cosmetic product stick 12.

The cup 26 includes at least one lug (not visible), preferably two diametrically opposite lugs.

The lugs respectively engage with slides 25 of the guide 22, the slides 25 extending axially rectilinearly. Each slide 25 advantageously includes, to each of its upper and lower ends, an angular indentation 25*a* forming an end position abutment for the lugs of the cup 26.

The sheath 24 surrounds the guide 22. The sheath 24 internally includes two helical grooves 27 with which the free end of the lugs respectively engage, each lug radially passing through the slide 25 associated with the guide 22 to be engaged in a groove 27.

The mechanism 20 here also includes a casing 28, also called sleeve or also liner. As represented in FIG. 2, the casing 28 externally surrounds the sheath 24. More specifically, the casing 28 covers almost all of the sheath 24, except for a lower section of the sheath 24.

According to the invention, the casing 28 and the sheath 24 are made of plastic material.

The plastic material of the casing 28 and the plastic material of the sheath 24 can be chosen from among the polypropylene and/or polyethylene terephthalate.

The casing 28 and the sheath 24 can be made of the same plastic material or made of two different plastic materials. Preferably the casing 28 and the sheath 24 are made of the same plastic material.

Advantageously, the cup 26 and/or the guide 22 are also provided, made of plastic material chosen from among polypropylene and/or polyethylene terephthalate.

Thus, advantageously, all the parts of the mechanism 20 are made of plastic material chosen from among polypropylene and/or polyethylene terephthalate.

The parts made of plastic material can be easily obtained by injection and lead to a light mechanism 20.

In addition, plastic materials can be coloured, thus guaranteeing the aesthetic quality.

Moreover, the use of plastic materials, in particular of similar plastic materials for the assembly of the mechanism 20 allows to facilitate the recycling. In particular, polypropylene and polyethylene terephthalate are two plastic materials of which the recycling cycle is well-known.

Advantageously, the cap 14 and/or the base 16 are also made of plastic material chosen from among polypropylene and/or polyethylene terephthalate.

The cap 14 and the base 16 can be made of the same plastic material or made of two different plastic materials. Preferably, the cap 14 and the base 16 are made of the same plastic material.

Advantageously, the assembly of the receptacle 10, i.e. the assembly of the mechanism 20, as well as the cap 14 and the base 16 are made of plastic material chosen from among polypropylene and/or polyethylene terephthalate, in particular made of the same plastic material.

There again, the use of plastic materials, in particular of similar plastic materials for the assembly of the receptacle 10 allows to facilitate the obtaining of parts which can be easily obtained by injection and lead to a light receptacle 10.

In addition, the plastic materials can be coloured and thus guarantee an aesthetic quality.

Moreover, the use of plastic materials, in particular of similar plastic materials for the assembly of the mechanism 20 allows to facilitate the recycling. In particular, polypropylene and polyethylene terephthalate are two plastic materials of which the recycling cycle is well-known.

The guide 22 includes a wheel 30. The wheel 30 is located axially at the lower end of the guide 22.

The wheel 30 is intended to allow the rotating of the guide 22 causing, along the direction of rotation, an axial ascending or descending movement of the cup 26 and doing so, of the cosmetic product stick 12.

In this embodiment, the wheel 30 is a separate part fixedly applied on the guide 22. In a variant, the wheel 30 is integrally made, made of one single part, with the guide 22 of the mechanism 20

In such a receptacle 10, the wheel 30 of the mechanism 20 is actuated, after having previously removed the cap 14, by way of the base 16.

In a variant of the embodiment, the casing 28 and/or the sheath 24 are extended beyond the wheel, this in order to prevent or at the very least to make access to the wheel 30 difficult. Such a configuration allows to limit the actuation of the mechanism 20 by a user even before the mechanism 20 had been associated with the corresponding base 16.

Consequently, the wheel 30 and the base 16 must, on the one hand, be connected axially together and, on the other hand, be connected in rotation to ensure the transmission of the wheel 30 of the mechanism 20 of any rotation movement applied to the base 16. The wheel 30 is thus intended to be connected in rotation with the base 16 when the mechanism 20 is mounted on the base 16.

For this, the actuation base 16 includes fixing means for axially connecting the actuation base 16 with the wheel 30 of the mechanism 20.

The fixing means include four tabs 32 which extend axially upwards from a low portion of the actuation base 16.

The four tabs 32 of the actuation base 16 are angularly regularly distributed, that is at 90°. The tabs 32 are inserted in a complementary orifice which is arranged centrally in the wheel 30 of the mechanism 20. Advantageously, the tabs 32 are flexible.

The free end of each tab 32 is configured to form a hook 34 which engages with an upper edge 36 of the orifice of the wheel 30 in order to axially block the actuation base 16.

The fixing tabs 32 allow to axially connect the actuation base 16 to the wheel 30 of the mechanism 20.

The blocking in rotation of the wheel 30 and the base is done by a complementary notching of the wheel 30 and tabs 32, i.e. an assembly of grooves 38 which extend axially, parallel to one another on an inner surface of the wheel 30 and on the outer surface of the tabs 32 of the base 16.

In such a mechanism 20, the casing 28 and the sheath 24 are integral in rotation and in translation.

For this, according to the invention, the casing 28 and the sheath 24 both being made of plastic material, they are interfused in at least one point, called assembly point 40.

Advantageously, in the embodiment represented here, the mechanism 20 includes two diametrically opposite assembly points 40.

The two assembly points 40 are arranged on a lower portion of the casing 28 and of the sheath 24 opposite an upper portion including an opening 42 through which the cosmetic product can exit.

Thus, the two assembly points 40 are visible on an outer surface 44 of the casing 28.

In particular, in an embodiment represented here, each of the assembly points 40 is disposed both on the outer surface 44 of the casing 28 and on an outer surface 46 of the sheath 24.

The assembly point 40 is in the form of a hollow triangle having an upper rounded peak 48 (i.e. a peak directed towards the upper portion including the opening).

Advantageously, the at least one assembly point 40 is obtained by an obtaining method including a step wherein the at least one assembly point 40 is obtained by welding, such as, for example, a thermal punching.

The thermal punching can be obtained by application, the knocking of at least one thermally regulated punch on the outer and/or inner surfaces of the casing 28 and/or of the sheath 24. The application time of the punch(es) is defined according to the size of the mechanism 20, of the plastic material type, of the thickness of the casing 28 and/or of the sheath 24, of the desired final interfusing level between the casing 28 and the sheath 24.

To obtain the embodiment represented, two triangular-shaped diametrically opposite punches have been knocked on the outer surfaces 44, 46 of the casing 28 and of the sheath 24.

Thus, the casing 28 and the sheath 24 are interfused by heating and pressure of a zone forming the assembly point 40. In other words, the plastic materials of the casing 28 and of the sheath 24 melt under the heat and are mixed to form the assembly point 40, in particular once the zone is cooled. The pressure exerted during the punching allows to create a mark forming the assembly point 40.

The interfusing of the casing 28 and of the sheath 24 can be detected by a mixture of the materials of the sheath 24 and of the casing 28.

In the case of a casing 28 and of a sheath 24 of different colours, the assembly point 40 can have a colour difference, with respect to the remainder of the casing 28 and of the sheath 24 due to the mixing of the two plastic materials. The assembly point 40 can thus be seen. This change of colour is particularly visible when the assembly point 40 is located on the outer surfaces 44, 46 of the casing 28 and of the sheath 24. This difference of colour is particularly visible in the zone of the casing 28 adjacent to the sheath 24 and in the zone of the sheath 24 adjacent to the casing 28.

The assembly point 40 can also be seen by a hollow-shaped mark left by the punching of the outer surface 44 of the casing 28 and/or on the outer surface 46 of the sheath 24.

Advantageously, the at least one assembly point 40 can represent a pattern, such as a logo, a letter, a text, or any other suitable pattern.

In the case of a plurality of assembly points 40, these can be distributed over the perimeter of the casing 28, as is represented here with two assembly points 40.

The assembly points 40 can also be distributed over the whole height of the casing 28 (not represented).

The distribution can be regular or random.

In another embodiment, not represented, the mechanism 20 can also include one single assembly point 40.

In the embodiment represented here, the casing 28 is further held on the sheath 24 by way of at least one excess thickness 50 of material located between the sheath 24 and the casing 28 such that the sheath 24 and the casing 28 are integral at least in translation.

The casing 28 and the sheath 24 are thus mounted by force on one another allowing to improve their holding, in particular at the pull-out and at the rotation with respect to one another. Moreover, the use of an excess thickness 50 of material between the casing 28 and the sheath 24, in other words in an inner zone of the mechanism 20 allows to conserve a good visual appearance of the mechanism 20.

Thus, the excess thickness 50 of material can be located on an inner surface 52 of the casing 28 (embodiment represented here) or on the outer surface 46 of the sheath 24 (not represented) or also on the inner surface 52 of the casing 28 and on the outer surface 46 of the sheath 24 (not represented).

It can be, for example, one single excess thickness 50. Advantageously, this is in this case, for example, an excess thickness 50 which extends over the whole perimeter of the inner surface 52 of the casing 28 and/or of the outer surface 46 of the sheath 24, such as a protrusion.

The mechanism 20 can also include a plurality of excess thicknesses 50 of material distributed over the inner surface 52 of the casing 28 and/or over the outer surface 46 of the sheath 24.

The excess thicknesses 50 of materials can be discrete points distributed over the whole inner surface 52 of the casing 28 and/or of the outer surface 46 of the sheath 24.

The excess thicknesses 50 of material can also be discrete points distributed over the whole perimeter of the inner surface 52 of the casing 28 and/or of the outer surface 46 of the sheath 24, so as to form, for example, a discontinuous protrusion.

These can also be excess thicknesses 50 extending over the whole perimeter of the inner surface 52 of the casing 28 and/or of the outer surface 46 of the sheath 24, such as protrusions.

In the embodiment represented here, the at least one excess thickness 50 of material is two protrusions 50 of material arranged over the perimeter of the inner surface 52 of the casing 28 at the level of the lower portion of the casing 28 and of the sheath 24 where the two assembly points 40 mentioned above are located.

Contrary to known techniques, such as clamping or gluing, the presence of an excess thickness between the casing and the sheath and/or the interfusing between these two parts allows a connection between the casing and the sheath which is advantageously simple, reliable and economical.

Indeed, the assembly of the two parts can be done by clamping but very often, this is not sufficient, in particular at the level of the axial connection.

Another solution for assembling the two parts is the gluing technique. However, the use of glue when the two parts are assembled by gluing, induces risks of pollution of the cosmetic product by the glue of which it is difficult to control the quantity and distribution with great precision during the assembly.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A mechanism intended to be mounted on an actuation base of a receptacle for applying a cosmetic product, the mechanism being designed to make the cosmetic product exit by at least one rotation movement, characterised in that said mechanism comprises:

at least one sheath made of plastic material internally comprising at least one helical groove;

a guide comprising a wheel intended to allow the rotation of the guide, the wheel being intended to be connected in rotation to the base; and, a casing made of plastic material external to the sheath, the casing and the sheath being interfused in at least one point, called assembly point, so as to be integral in rotation and in translation.

2. The mechanism according to claim 1, wherein the guide is surrounded by the sheath.

3. The mechanism according to claim 1, wherein the guide comprises slides extending axially rectilinearly.

4. The mechanism according to claim 1, wherein the casing has an outer surface on which the at least assembly point is visible.

5. The mechanism according to claim 1, wherein the mechanism comprises a plurality of assembly points.

6. The mechanism according to claim 5, wherein the plurality of assembly points is distributed over the perimeter of the casing.

7. The mechanism according claim 1, wherein the at least one assembly point is a pattern, such as a logo, a letter, a text.

8. The mechanism according to claim 1, wherein the plastic material of the sheath and the plastic material of the casing are chosen from among polypropylene and/or polyethylene terephthalate.

9. A receptacle for applying a cosmetic product comprising:

a cap; and, an actuation base comprising a mechanism comprising at least one sheath made of plastic material internally comprising at least one helical groove, a guide comprising a wheel intended to allow rotation of the guide, the wheel adapted for connection in rotation to the base, and a casing made of plastic material external to the at least one sheath, the casing and the sheath being interfused in at least one point so as to be integral in rotation and in translation, the actuation base allowing an inlet and/or an outlet of the cosmetic product.

10. A method for obtaining a mechanism, comprising a step of welding at least one assembly point of a mechanism comprising at least one sheath made of plastic material internally comprising at least one helical groove, a guide comprising a wheel intended to allow rotation of the guide, the wheel adapted for connection in rotation to the base, and a casing made of plastic material external to the at least one sheath, the casing and the sheath being interfused in the assembly point so as to be integral in rotation and in translation.

11. The method according to claim 10, wherein, the welding is obtained by thermal punching.

* * * * *